United States Patent [19]

Mettler

[11] 4,328,077

[45] May 4, 1982

[54] METHOD FOR REFORMING A USED TUBULAR MOLD FOR CONTINUOUS CASTING

[75] Inventor: Diethelm Mettler, Küsnacht, Switzerland

[73] Assignee: Accumold AG, Fischenthal, Switzerland

[21] Appl. No.: 189,170

[22] Filed: Sep. 22, 1980

[30] Foreign Application Priority Data

Nov. 7, 1979 [CH] Switzerland ..... 9966/79

[51] Int. Cl.[3] ..... C25D 7/04; C25D 5/34

[52] U.S. Cl. ..... 204/26; 51/315; 164/92.1; 204/29; 427/135

[58] Field of Search ..... 204/26, 29, 16; 427/135; 164/92.1, 100, 418; 51/313, 315; 264/36, 39

[56] References Cited

U.S. PATENT DOCUMENTS

| | | | |
|---|---|---|---|
| 3,187,474 | 6/1965 | Setzler | 51/313 |
| 3,414,488 | 12/1968 | Willingham | 204/37 R |
| 3,680,799 | 8/1972 | Hallerback | 241/183 |
| 3,927,546 | 12/1975 | Shrum | 72/56 |
| 4,197,902 | 4/1980 | Von Jan et al. | 164/418 |
| 4,220,027 | 9/1980 | Johnson et al. | 72/56 |

OTHER PUBLICATIONS

Frederick A. Lowenheim, *Electroplating,* McGraw-Hill, New York, 1978, pp. 97–98.

*Metal Finishing Guidebook and Directory for* 1978, Metals and Plastics Publications, Inc., Hackensack, N.J., pp. 82–98.

*Primary Examiner*—Delbert E. Gantz
*Assistant Examiner*—William Leader
*Attorney, Agent, or Firm*—Werner W. Kleeman

[57] ABSTRACT

In order to reform or rejuvenate a spent or worn tubular mold used for continuous casting, friction bodies are introduced into the hollow mold compartment following the grinding of the inner surface of such mold compartment, the ends of the tubular mold are closed, the tubular mold and the friction bodies are placed into a relative movement with respect to one another and thereafter the inner surfaces of the mold are galvanically coated.

4 Claims, No Drawings

METHOD FOR REFORMING A USED TUBULAR MOLD FOR CONTINUOUS CASTING

CROSS REFERENCE TO RELATED CASE

This application is related to my commonly assigned, copending U.S. application Ser. No. 06/164,353, filed June 30, 1980, entitled: "METHOD OF RECALIBRATING A WORN CONICAL, SPECIALLY CURVED TUBULAR MOLD".

BACKGROUND OF THE INVENTION

The present invention relates to a new and improved method for reforming or rejuvenating a used tubular mold employed for continuous casting, wherein damaged locations at the inner surfaces of the mold are ground.

For the continuous casting of high melting metals, such as typically steel and so forth, there are employed, among other things, independently of the strand cross-section, one-part tubular molds or known constructions. These molds can be fabricated from copper or copper alloys.

According to a presently known fabrication technique, as taught in German Pat. No. 1,809,633, an arbour or mandril is forced into a pre-formed tubular mold blank. This arbour or mandril possesses the final internal dimensions and the final shape of the tubular mold. Thereafter, the tubular mold is plastically deformed by a drawing operation in conformity with the shape of the arbour or mandril. Therafter, the mandril is again removed from the tubular mold which has solidified during the cold working.

In most instances the inner surfaces of continuous casting molds are coated with a material of greater wear resistance than copper in order to prevent the deposition of copper upon the cast product and to increase the longevity. A frequently employed coating process is the generally known galvanic chrome-plating. For this purpose an anode is placed into the copper tubular mold serving as the cathode, and the anode and cathode are immersed in a chromium acid solution. Following application of a direct-current voltage disassociated chromium ions are separated out on the copper. The quality of the separated-out chromium layer, depends, among other things, upon the actual construction or configuration of the continuous casting mold at the corner regions, but also upon the surface properties of the material which is to be coated. A rough surface also will be rough even after the chrome-plating operation. In terms of a spent or used mold this means that because of the roughness which prevails by virtue of the post-machining, for instance the grinding work, there will be present within the continuous casting mold an increased friction of the continuously cast strand within the casting mold, so that there can exist increased wear and transverse fissures in the cast product which, in the worst case, can lead to metal break-out.

According to a further method which has become known to the art and which is utilized more recently, for instance as taught in German Pat. No. 2,533,528 and the corresponding U.S. Pat. No. 4,220,027, used, worn, straight or curved tubular molds which also possess a conical hollow mold compartment, can be recalibrated to the original mold dimensions by an explosive forming technique. With this method the inner surfaces of the tubular mold again have imparted thereto the properties of a new mold. In practicing such method, prior to the explosive forming operation, the surface flaws or defects are manually ground away with the aid of a suitable grinding apparatus, in order to eliminate right from the start material overlaps of the faulty edges during the explosive forming operation.

If such type of recalibrated tubular molds are coated, then it can happen that the previous material protruberances or raised portions which were formed due to the grinding operation and which have been pressed flat because of the explosive forming operation—a scratch viewed in enlargment appears as an extended crater composed of a depression within the material and a lateral mound or pile of displaced away material—will again reform as raised portions or protruberances due to the action of the electromagnetic voltage field of the galvanization process, chromium will again separate out at such protruberances and as the final product there will be present a rough mold inner surface possessing all of the previously described drawbacks.

SUMMARY OF THE INVENTION

Therefore, with the foregoing in mind it is a primary object of the present invention to provide a new and improved method of reforming a used tubular mold for continuous casting in a manner not associated with the aforementioned drawbacks and limitations of the prior art proposals.

Another and more specific object of the present invention aims at avoiding the above-described drawbacks which are associated with post-machining work, and specifically, it is intended to provide a suitable, economical method for surface treatment of the inner surfaces of continuous casting molds, by means of which it is possible, with relatively small material removal, to obtain a decisive improvement in the surface quality as concerns a subsequent galvanic coating operation.

Yet a further significant object of the present invention aims at avoiding the disadvantages which arise in the cast product by virtue of the post-machining of the continuous csting mold.

DETAILED DESCRIPTION OF THE PREFERRED EMBODIMENTS

Now in order to implement the foregoing objects and others which will become more readily apparant as the description proceeds, the method of reforming a used or spent tubular mold employed for continuous casting operations is manifested by the features that following the grinding of the continuous casting mold there are introduced into the hollow mold compartment of such mold friction bodies, then both ends of the tubular mold are closed, the tubular mold and the friction bodies are placed into relative movement with respect to one another, and thereafter the inner surfaces of the continuous casting mold are again galvanically coated.

By virtue of these operations it has been found, both when working with pebbles or gravel stones as the friction bodies as well as other commercially available friction bodies, it is possible to obtain with an inexpensive mold reforming method such good surface properties of the reformed mold that upon coating of the mold compartment surfaces there can be obtained a really fine and uniform chromium layer. In this way it is possible by virtue of the fine surfaces which are present in the reformed mold to avoid any too great friction between the cast product and the mold inner surfaces, and thus, there is beneficially extensively eliminated metal break-out for such reasons.

The strived for smooth mold surfaces are obtained with very modest removal of material at the continuous casting mold, since particularly there are advantageously removed disturbing material raised portions or protruberances. Due to the thus obtained uniform chromium layer there is realized an increased longevity of the continuous casting molds.

Advantageously, the relative movement can be accomplished by rotating the tubular mold about its lengthwise axis while in approximately horizontal position, in that there is thus undertaken the relative movement of the friction bodies essentially perpendicular to the scratches which are formed during the grinding operation.

When using the inventive method it has been found to be advantageous if the inner surfaces of the mold, following the working with the friction bodies, are recalibrated by explosive forming. In this way there can be avoided a time consuming manual fine grinding operation and there can be realized, because of the increased output, an appreciable savings in cost.

Moreover, it is possible to avoid that irregularities in the material which have been pressed flat due to the high-energy deformation, and as such are unavoidable during the grinding work, will again reform at the inner surfaces of the mold by virtue of the galvanic potential field and that after the coating there will appear a rough chromium layer as has already been heretofore described, with the resultant drawbacks.

Additionally, it has been found that in order to obtain the desired fineness of the inner surfaces of the continuous casting mold, if such tubular molds are treated with the friction bodies as contemplated by the invention, there is required appreciably less explosive material for the reforming work. Consequently, the service life of the arbour or mandril is appreciably increased, so that there can be markedly reduced the mandril costs per tubular mold.

There will now further be described the invention in detail based upon the machining of a spent or used tubular mold. A curved, conical mold used for the continuous casting of steel billets having a dimension of 100 $mm^2$ is removed from the manufacturing operation after approximately 250 pours or teeming operations because of scratches and scoring appearing at the inner walls of the mold and because intolerable changes of its internal mold geometry have occurred.

With the aid of the method of rejuvenating such spent or used continuous casting mold, as contemplated by the invention, it is possible for such rejuvenated or reformed tubular mold to participate in at least one further continuous casting operation. To this end, following the removal of the galvanically applied layer the damaged locations appearing at the inner surfaces of the tubular mold are ground with the aid of a manual grinding apparatus or grinder. Then, if the state-of-art teachings were practiced it would be necessary to carry out a fine-machining operation with fine-grain grinding means. This fine-machining is extremely time-consuming, and because of the very fine grinding dust which is produced constitutes an unacceptable health hazard for the operating personnel, and furthermore, it does not have the desired effect of obtaining, in particular, a mold surface free of scratches and grinding marks. In order to eliminate these drawbacks the coarsely ground hollow mold compartment is filled to approximately 50 percent of its volume with a suitable grinding material, for instance pebbles or gravel stones and a suitable additive, such as water or the like, and then is closed at both ends by any appropriate closure plates. A shaft which can extend through the hollow mold compartment pierces at both of its ends the sealing cover plates at the ends of the continuous casting mold and then is mounted at both shaft ends in a horizontal position. One end of the shaft then can be driven in any appropriate fashion, for instance by a chain drive which connects such shaft end with a drive motor so that there is accomplished the desired relative movement between the tubular mold and the inserted grinding material in the form of the mentioned friction bodies. A random number of such devices can be interconnected and driven by the same drive, for instance a reversible gearing motor. There also can be provided standard clutches or couplings for the independent connection and disconnection of individual ones of these devices. In this way it is possible to rotate for different periods of time individual ones of the molds, independent of their starting condition, without influencing the smoothing operation at other ones of the molds. The described arrangement for possibly rotating the continuous casting molds to accomplish the relative movement between the mold and the friction bodies is but exemplary and is in no way intended to be construed as limiting the invention, since quite obviously other arrangements can be employed for accomplishing such relative movement.

By turning-on the drive unit the tubular mold is rotated about its lengthwise axis, so that the friction or abrasion bodies are continuously agitated or tumbled, and this relative movement between the friction bodies and the tubular mold results in an erosion of the material within the hollow mold compartment. Because of the shape of the friction bodies—they can have a rectangular, elliptical, polygonal configuration and so forth by way of example, or can be constituted by bodies having rounded corners—and because of their slight grinding pressure, there is avoided an erosion which leaves scratch marks. By varying the rotational speed as well as the treatment duration it is possible to affect the removal of material. In the embodiment under discussion the duration of treatment amounted to about 48 hours. With the curved or arc-shaped continuous casting mold under consideration there additionally was altered the rotational direction at certain regular time intervals, to thereby avoid any irregular material removal at the edge regions of the mold. After completion of what may be termed such fine-abrasion operation the continuous casting mold was galvanically coated with chromium. Thereafter, the inner surfaces of the continuous casting mold possessed a condition essentially corresponding to that of a new mold.

Apart from a rotational movement of the continuous casting mold about its lengthwise axis it would also be possible to carry out other types of movements, such as mold rotation about the transverse axis, rotation about the mold lengthwise axis while superimposing thereon a movement along a circular path of travel, generating a centrifical force, in order to thereby intensify the grinding pressure, wobble movements and tilt movements and the like.

By providing a multiplicity of such devices for processing the molds it is possible to realize an appreciably more rational processing of the inner surfaces of the continuous casting mold compared with manual fine grinding, prior to the explosive reforming or forming work, which then is beneficially associated with a decisive improvement in the surface quality as a prerequisite for good chrome-plating and thus, increased longevity of the continuous casting mold. Explosive forming or reforming techniques are known to the art for instance from U.S. Pat. No. 3,927,546 and also from my aforementioned, commonly assigned, copending U.S. application Ser. No. 06/164,353, filed June 30, 1980.

By virtue of the wear in the spent tubular mold, the distortion due to the thermal action and the grinding there are formed deviations from the original mold geometry which can have a disadvantageous effect upon the reuse of the tubular mold. By recalibrating the mold by means of the explosive reforming technique, as above described, it is possible to again establish the original mold geometry.

The described method can also be used for tubular molds for the continuous casting of non-ferrous metals.

While there have been described the present preferred embodiments of the invention, it is to be distinctly understood that the invention is not limited thereto, but may be otherwise variously embodied and practiced within the scope of the following claims.

What I claim is:

1. A method of rejuvenating a spent tubular mold for continuous casting, comprising the steps of:

grinding damaged locations of the inner surfaces of the tubular mold;

introducing abrasion material into the hollow mold compartment of the tubular mold following the grinding operation;

closing the opposed ends of the tubular mold;

moving the tubular mold and the abrasion material relative to one another so as to cause erosion of mold material at the inner surfaces of the mold; and thereafter galvanically coating the inner surfaces of the tubular mold.

2. The method as defined in claim 1, wherein:

the relative movement between the tubular mold and the abrasion material is accomplished by rotating the tubular mold about its lengthwise axis while in approximately horizontal position.

3. The method as defined in claim 2, further including the steps of:

recalibrating the inner surfaces of the tubular mold by explosive forming following the processing of such inner surfaces of the tubular mold by the abrasion material.

4. The method as defined in claim 1, further including the steps of:

recalibrating the inner surfaces of the tubular mold by explosive forming following the processing of such inner surfaces of the tubular mold by the abrasion material.

* * * * *